US006914165B2

(12) United States Patent
Flego et al.

(10) Patent No.: US 6,914,165 B2
(45) Date of Patent: Jul. 5, 2005

(54) PROCESS FOR OBTAINING A "DIESEL CUT" FUEL BY THE OLIGOMERIZATION OF OLEFINS OR THEIR MIXTURES

(75) Inventors: Cristina Flego, Trieste (IT); Carlo Perego, Milan (IT); Mario Marchionna, Milan (IT)

(73) Assignees: Snamprogetti S.p.A., S. Donato Mil.se (IT); Enitecnologie S.p.A., S. Donato Mil.se (IT)

( * ) Notice: Subject to any disclaimer, the term of this patent is extended or adjusted under 35 U.S.C. 154(b) by 649 days.

(21) Appl. No.: 10/109,660

(22) Filed: Apr. 1, 2002

(65) Prior Publication Data

US 2002/0183576 A1 Dec. 5, 2002

(30) Foreign Application Priority Data

Apr. 12, 2001 (IT) ..... MI2001A0782

(51) Int. Cl.[7] ..... C07C 2/12
(52) U.S. Cl. ..... 585/533; 585/329
(58) Field of Search ..... 585/533, 329

(56) References Cited

U.S. PATENT DOCUMENTS 5,518,978 A 5/1996 Flego et al.
5,602,292 A 2/1997 Perego et al.
5,608,133 A 3/1997 Chang et al.
5,625,115 A 4/1997 Flego et al.
5,767,038 A 6/1998 Perego et al.
5,908,968 A 6/1999 Carati et al.
5,968,344 A 10/1999 Perego et al.
5,981,419 A 11/1999 Carati et al.

FOREIGN PATENT DOCUMENTS

EP 0 293 950 12/1988
WO WO 89/08090 9/1989
WO WO 93/06069 4/1993

OTHER PUBLICATIONS

U.S. Appl. No. 09/168,564, filed Oct. 9, 1998, Calemma et al.

U.S. Appl. No. 10/276,692, filed Nov. 18, 2002, Flego et al.

*Primary Examiner*—Thuan D Dang
(74) *Attorney, Agent, or Firm*—Oblon, Spivak, McClelland, Maier & Neustadt, P.C.

(57) ABSTRACT

Process for obtaining a "diesel cut" fuel having a CN cetane number equal to or greater than 48 and a content of aromatics lower than 0.4% by weight starting from olefins or their mixtures, characterized in that it comprises oligomerizing said olefins having from 2 to 10 carbon, distilling the stream obtained from the oligomerization, and hydrogenating the separated $C_{12}$–$C_{24}$ hydrocarbon stream.

8 Claims, No Drawings

PROCESS FOR OBTAINING A "DIESEL CUT" FUEL BY THE OLIGOMERIZATION OF OLEFINS OR THEIR MIXTURES

The present invention relates to a process for obtaining a "diesel cut" fuel by means of the oligomerization of olefins or their mixtures in the presence of a particular synthetic porous crystalline material.

The term "diesel cut" refers to a medium distillate with a boiling point range of the products of which it is composed, varying from 200 to 360° C. and with a density ranging from 0.760 to 0.935 at 15° C.

The oligomerization of light olefins, industrially applied mainly with homogeneous catalysis, was one of the first examples of the application of heterogeneous acid catalysis and in particular of zeolites in acid form. Oligomerization processes of light olefins ($C_2$–$C_4$) are mainly used for the synthesis of higher olefins and are distinguished by their flexibility as they allow the production of olefinic mixtures having appropriate characteristics (chain length, linear or branched chain type, etc).

During oligomerization processes, in fact, in addition to diesel cut products, products belonging to the gasoline fraction (boiling point lower than 180° C. and high octane number), can also be obtained.

During the oligomerization of olefins, the physical characteristics of the products obtained (cetane number, boiling point, viscosity, etc.) are greatly influenced by the branching degree of the products. If the catalyst used is not selective, the branching becomes considerable, thus lowering the cetane number in the diesel fuel. For this reason it is preferable to use a selective catalyst, consisting of zeolites in acid form, which allows the branching degree to be reduced and therefore favouring the cetane number.

The use of selective zeolites, such as ZSM-5 has been known for some time. The MOGD process (Mobil Olefins to Gasoline and Distillate), proposed by Mobil (U.S. Pat. No. 4,150,062; U.S. Pat. No. 4,227,992) and developed between the seventies' and eighties', in fact used ZSM-5 zeolite as catalyst. The products obtained from the reaction of butenes are trimers and tetramers, characterized by a low branching degree. The gas oil fraction however is lower than that of the jet fuel fraction and consequently, even if this process offers a good quality gas oil (cetane number >50), it is more interesting for the production of jet fuel than gas oil.

Other zeolites with medium pores, ZSM-12, -23, etc. produce oligomers with a low branching degree due to the "shape selectivity" phenomenon. This is such that the gasoline cut, without aromatics, has a low octane number whereas the diesel cut has a high cetane number. Examples of the use of this type of material, for producing diesel fuel with a high cetane index, are provided in some recent patents of Mobil (U.S. Pat. No. 5,639,931; U.S. Pat. No. 5,780,703).

Amorphous acid materials (silico-aluminas), large pore zeolites, resins with cationic exchange and supported acids (e.g. phosphoric acid), on the other hand, produce oligomers with a high branching degree and a diesel cut with a low cetane number.

All acid carriers supported with Ni also belong to a special category. This metal in fact is capable of competing with the acid sites of the carrier, reducing the isomerization reactions and forming oligomers with a low branching degree (JP 07309786), but at the same time favouring dimerization with respect to oligomerization to heavier products, creating products with a boiling point lower than that which distinguishes diesel cuts.

Mobil is the most active company in this field, also for defending its process based on ZSM-5. It has patented catalytic systems with modified zeolites, such as ZSM-23 with an external surface deactivated with boron nitrides (U.S. Pat. No. 5,250,484) or subjected to temperature steaming treatment and with the external surface deactivated by suitable coke deposits (U.S. Pat. No. 5,234,875). In both of these oligomerization processes, the yield of the diesel fraction is always lower (<20% by weight) with respect to the gasoline fraction. It has also patented, with modified ZSM-5 and ZSM-23, a multistep process which couples metathesis reactions and subsequent oligomerization with the oligomerization of light olefins, obtaining cetane numbers on the end-product of 50–70 (WO 93/06069).

Broken Hill has patented zeolites (ZSM-5, -11, -12) modified with >0.2% by weight of K, Na, Ca oxides (with respect to the weight of the catalyst, intended as zeolite plus ligand) in combined FCC and oligomerization systems (U.S. Pat. No. 4,675,460). In all the examples of the patent, the yield of the diesel fraction is lower than 28% by weight with respect to all the products obtained.

Neste OY has obtained products with a cetane number equal to 49 and a yield of the diesel fraction lower than 50% by weight in the presence of ZSM-5 doped with 0.01%–1% by weight of Ca (EP 0539126); or equal to 55 and a yield in the diesel fraction of less than 58% by weight with ZSM-5 doped with 1–3% by weight of Cr (WO 96/20988).

Eniricerche S.p.A. and Agip S.p.A. have patented (IT-1204005) an oligomerization process of light olefins carried out in the presence of a zeolite structurally similar to ZSM-5, titaniumaluminumsilicalite (Al-TS-1), which allows mixtures of olefins and aromatics having from 5 to 20 carbon atoms to be obtained, with a selectivity of over 87%.

We have found that by effecting the oligomerization reaction of olefins in the presence of a titaniumaluminumsilicalite in certain ratios and with an extraframework titanium oxide content of zero or below certain values, and operating at a high pressure, it is possible to obtain high yields of products with a high cetane number, suitable as fuels for diesel engines, in which the aromatic hydrocarbons are either substantially absent or present in a very limited quantity.

The process, object of the present invention, for obtaining a "diesel cut" fuel having a CN (cetane number) equal to or greater than 48 and a content of aromatics of less than 0.4% by weight starting from light olefins or their mixtures, is characterized in that it comprises the following steps:

oligomerizing said olefins in the presence of synthetic zeolites containing silicon, titanium and aluminum oxides, having a molar ratio $SiO_2/Al_2O_3$ ranging from 100 to 300, preferably from 200 to 300, a molar ratio $SiO_2/TiO_2$ greater than 41, preferably equal to or greater than 46, and a extraframework titanium oxide content which is zero or less than 25% by weight, preferably zero or at the most less than 5%, with respect to the whole titanium oxide present, at a temperature ranging from 180 to 300° C., preferably from 200 to 250° C., at a pressure greater than 40 atm., preferably ranging from 45 to 80 atm. and a WHSV space velocity equal to or greater than 1 $h^{-1}$, preferably ranging from 1.5 to 3 $h^{-1}$, in order to obtain a stream essentially consisting of oligomerized $C_5$–$C_{24}$ hydrocarbons;

distilling the stream obtained from the oligomerization in order to separate a $C_{12}$–$C_{24}$ hydrocarbon stream from a $C_5$–$C_{12}$ hydrocarbon stream;

hydrogenating the separated $C_{12}$–$C_{24}$ hydrocarbon stream.

The light olefins used for the oligomerization reaction have a number of carbon atoms ranging from 2 to 10, preferably from 2 to 6: ethylene, propylene, 1-butene, 2-butene cis and trans, pentenes and hexenes, either singly or in a mixture, are preferred.

Furthermore, the olefins can be used in pure form or diluted with inert products such as nitrogen, methane, ethane, butane and other higher paraffins, etc., as well as with part of the reaction products.

The products obtained with said oligomerization are mainly olefins having from 5 to 24 carbon atoms with a content of aromatic hydrocarbons of less than 0.4% by weight.

The oligomerization reaction can be carried out in a fixed or fluidized bed at temperatures, pressures, flow-rates of the reagents which can vary within the ranges indicated above and also depending on the particular mixture fed to the reactor.

The $C_5$–$C_{12}$ stream separated by distillation is preferably recycled to the oligomerization step.

The distillation step can be carried out with the conventional methods in order to separate the products with boiling points within the range of 200–360° C.

The hydrogenation step of the separated $C_{12}$–$C_{24}$ stream can be carried out according to the known procedures, either with the continuous or batch method. In particular, it can be effected by feeding hydrogen at a pressure ranging from 5 to 20 atm. and at a temperature ranging from 50 to 150° C. and reacting for a time varying from 2 to 20 hours in the presence of a hydrogenation catalyst, supported palladium or platinum, for example 5% by weight of palladium or platinum on activated carbon.

The product obtained after the hydrogenation step, the "diesel cut" fuel, can even reach a CN equal to or higher than 50 and a content of aromatics which is zero or at least less than 0.2% by weight. The yield of the diesel fraction is always higher than 60% by weight with respect to the total $C_5$–$C_{24}$ products obtained in the oligomerization reaction.

Some examples are provided for a better illustration of the present invention but should in no way be considered as limiting its scope.

EXAMPLE 1

An Al-TS-1 zeolite is synthesized with molar ratios from chemical analysis of $SiO_2/Al_2O_3$=218 and $SiO_2/TiO_3$=122. The catalyst is a crystalline zeolite and the Ti is completely in the framework as demonstrated by XRD and UV-Vis analyses.

The synthesis is carried out as follows. A solution containing 210.4 g of TEOS (TetraEthylOrthoSilicate) and 11.52 g of TEOT (TetraEthylOrthoTitanate) is added to a solution consisting of 100.6 g of TPAOH (TetraPropylAmmonium hydroxide, 31.5% by weight in an aqueous solution containing no alkaline cations), 1.37 g of $Al(iPrOH)_3$ (aluminum isopropoxide), 50 g of $H_2O$. After hydrolysis and 3 h of aging at 40° C., a further 565.7 g of $H_2O$ are added. The reagent mixture thus obtained has a pH=11.6 and the following molar composition: $SiO_2/TiO_2$=20, $SiO_2/Al_2O_3$=300, templating agent/$SiO_2$=0.25 and $H_2O/SiO_2$=40. The mixture is transferred to a steel autoclave and heated to 100° C. under autogenous pressure for 5 days, continuously under stirring. The crystalline solid is discharged from the autoclave, separated from the mother liquor, dried at 120° C. for 4 hours and calcined at 550° C. for 5 hours in air.

EXAMPLE 2

An Al-TS-1 zeolite is synthesized with $SiO_2/Al_2O_3$=213 and $SiO_2/TiO_3$=50. The catalyst is a crystalline zeolite and the Ti is completely in the framework as demonstrated by XRD and UV-Vis analyses.

The synthesis is carried out as described in example 1, using a reagent mixture with the same molar composition. The mixture is transferred to a steel autoclave and heated to 180° C. under autogenous pressure for 4 hours, under static conditions.

EXAMPLE 3

An Al-TS-1 zeolite is synthesized with $SiO_2/Al_2O_3$=124 and $SiO_2/TiO_3$=41. The catalyst is a crystalline zeolite. The preparation is effected so that the Ti is only partially obtained in the framework, with the formation of anatase in the extraframework portion, as demonstrated by XRD and UV-Vis analyses.

The synthesis is carried out as described in example 1, using a reagent mixture with the same molar composition. The mixture is transferred to a steel autoclave and heated to 170° C. under autogenous pressure for 15 hours, under rocked stirring.

EXAMPLE 4

The catalyst of example 1 was tested in the oligomerization reaction of 1-butene in a fixed bed reactor under the conditions described below.

4 g of solid catalyst, ground and granulated to 20–40 mesh, are charged into the reactor in the centre of the isothermal zone of the oven by means of an appropriate porous septum. The catalytic test is preceded by an activation treatment at a temperature of 300° C. in a stream of nitrogen for 3 hours. At the end of the pretreatment, the reactor is cooled to room temperature, 1-butene is fed at a WHSV=2 $h^{-1}$ and the system is brought to a pressure of 45 bars and a temperature of 230° C.

The products obtained in the oligomerization reaction of 1-butene were analyzed via gas-chromatography. Table 1 indicates the conversion, selectivity to the $C_{12}$–$C_{20}$ fraction of interest and percentage of aromatics.

The distillation is effected under vacuum in a flask heated to 145° C. The light fraction is separated, whereas the diesel fraction is sent for hydrogenation. The hydrogenation is carried out in an autoclave under the following operating conditions: catalyst=5% Pd/carbon, $H_2$, P=50 Bars, T=90° C., 17 h. At the end of the test, the mixture of paraffins and catalyst is filtered, the catalyst is recovered for re-use. The cetane number (CN) is evaluated on the paraffinic solution.

EXAMPLE 5

The catalyst of example 2 was tested in the oligomerization reaction of 1-butene under the conditions of example 4. Table 1 indicates the conversion, selectivity to the $C_{12}$–$C_{20}$ fraction of interest, percentage of aromatics and the cetane number after distillation and hydrogenation as in example 4.

EXAMPLE 6

The catalyst of example 3 was tested in the oligomerization reaction of 1-butene under the conditions of example 5. Table 1 indicates the conversion, selectivity to the $C_{12}$–$C_{20}$ fraction of interest and percentage of aromatics.

EXAMPLE 7

The catalyst of example 2 was tested in the oligomerization reaction of 1-butene under the conditions of example 2 of IT-1204005 (T=260° C.; P=1 Ata; WHSV=0.6 $h^{-1}$. Table 1 indicates the conversion and selectivity to the $C_{12}$–$C_{20}$ fraction of interest, the percentage of aromatics and the cetane number after distillation and hydrogenation as in example 4.

TABLE 1

| Example | WHSV ($h^{-1}$) | T (° C.) | Conv. (%) | Sel $C_{12}$–$C_{20}$ (%) | CN | Aromatics (w %) |
|---|---|---|---|---|---|---|
| 4 | 2.06 | 230 | 99.93 | 69.99 | 50 | <0.1 |
| 5 | 2.03 | 230 | 99.90 | 73.83 | 53 | <0.1 |
| 6 | 2.04 | 230 | 44.65 | 28.00 | 45 | <0.1 |
| 7 | 0.6 | 260 | 99.90 | 87.50 | 40 | 2.5 |

What is claimed is:

1. A process for obtaining a "diesel cut" fuel having a CN cetane number equal to or greater than 48 and a content of aromatics lower than 0.4% by weight, starting from olefins or their mixtures, characterized in that it comprises the following steps:

oligomerizing said olefins having from 2 to 10 carbon atoms in the presence of synthetic zeolites containing silicon, titanium and aluminum oxides, having a molar ratio $SiO_2/Al_2O_3$ ranging from 100 to 300, a molar ratio $SiO_2/TiO_2$ greater than 41 and a extraframework titanium oxide content which is zero or less than 25% with respect to the whole titanium oxide present, at a temperature ranging from 180 to 300° C., at a pressure greater than 40 atm and a WHSV space velocity equal to or greater than 1 $h^{-1}$, in order to obtain a stream essentially consisting of oligomerized $C_5$–$C_{24}$ hydrocarbons;

distilling the stream obtained from the oligomerization in order to separate a $C_{12}$–$C_{24}$ hydrocarbon stream from a $C_5$–$C_{12}$ hydrocarbon stream;

hydrogenating the separated $C_{12}$–$C_{24}$ hydrocarbon stream.

2. The process according to claim 1, wherein the $C_5$–$C_{12}$ hydrocarbon stream separated by means of the distillation step is recycled to the oligomerization step.

3. The process according to claim 1, wherein the synthetic zeolites have a molar ratio $SiO_2/Al_2O_3$ ranging from 200 to 300 and a molar ratio $SiO_2/TiO_2$ equal to or greater than 46.

4. The process according to claim 1, wherein the synthetic zeolites have an extraframework titanium oxide content which is zero or less than 5% with respect to the whole titanium oxide present.

5. The process according to claim 1, wherein the reaction is carried out at a temperature ranging from 200 to 250° C., at a pressure ranging from 45 to 80 atm. and a WHSV space velocity ranging from 1.5 to 3 $h^{-1}$.

6. The process according to claim 1, wherein the olefins have a number of carbon atoms ranging from 2 to 6.

7. The process according to claim 6, wherein the olefins are selected from ethylene, propylene, 1-butene, 2-butene cis and trans, pentenes and hexenes, either singly or in a mixture.

8. The process according to at least one of the claims from 1 to 7, wherein the "diesel cut" fuel obtained has a CN equal to or greater than 50 and a content of aromatics equal to or lower than 0.2% by weight.

* * * * *